US009692143B2

(12) United States Patent
Fröhler et al.

(10) Patent No.: US 9,692,143 B2
(45) Date of Patent: Jun. 27, 2017

(54) ELECTRICAL CONNECTION DEVICE FOR PRODUCING A SOLDER CONNECTION AND METHOD FOR THE PRODUCTION THEREOF

(71) Applicant: KATHREIN-WERKE KG, Rosenheim (DE)

(72) Inventors: Christian Fröhler, Halfing (DE); Mario Günther, Kolbermoor (DE)

(73) Assignee: Kathrein-Werke KG, Rosenheim (DE)

( * ) Notice: Subject to any disclaimer, the term of this patent is extended or adjusted under 35 U.S.C. 154(b) by 132 days.

(21) Appl. No.: 14/367,162

(22) PCT Filed: Dec. 20, 2012

(86) PCT No.: PCT/EP2012/005315
§ 371 (c)(1),
(2) Date: Jun. 19, 2014

(87) PCT Pub. No.: WO2013/091880
PCT Pub. Date: Jun. 27, 2013

(65) Prior Publication Data

US 2015/0000976 A1 Jan. 1, 2015

(30) Foreign Application Priority Data

Dec. 22, 2011 (DE) ..... 10 2011 122 371

(51) Int. Cl.
*H01Q 3/26* (2006.01)
*H01R 4/02* (2006.01)
(Continued)

(52) U.S. Cl.
CPC ..... *H01R 4/02* (2013.01); *H01R 9/0515* (2013.01); *H01R 43/02* (2013.01); *H01Q 1/1207* (2013.01);
(Continued)

(58) Field of Classification Search
CPC ..... H01Q 3/26
(Continued)

(56) References Cited

U.S. PATENT DOCUMENTS 7,358,924 B2 4/2008 Boss et al.
2007/0010139 A1* 1/2007 Chen ..... H01R 12/585 439/751
(Continued)

FOREIGN PATENT DOCUMENTS

CN 383 082 10/1964
CN 1169515 A 1/1998
(Continued)

OTHER PUBLICATIONS

International Search Report for PCT/EP2012/005315, mailed Mar. 22, 2013.
(Continued)

*Primary Examiner* — Hoa C Nguyen
*Assistant Examiner* — Stanley Tso
(74) *Attorney, Agent, or Firm* — Nixon & Vanderhye P.C.

(57) ABSTRACT

This invention relates to an electrical connection device on a plate-type or strip-type material (1, 1'), which cannot be soldered or is difficult to solder or which is provided with a surface that cannot be soldered or is difficult to solder, having the following characteristics: A self-clinching bolt (5) is provided with a bolt head (7) that, relative to the bolt body (9) beneath, has a tapered cross section such that the bolt head (7) transitions, by way of a conical or shoulder-like sloping flank (11), into the bolt body (9) having an outer circumference (9') that has a diameter larger than that of the bolt head (7). The outer circumference (9') of the bolt body (9) is of smooth design, or is provided with a knurling (15). In the penetration area of the self-clinching bolt (5), the plate-type or strip-type material (1, 1') is provided with a
(Continued)

Figure 1A:
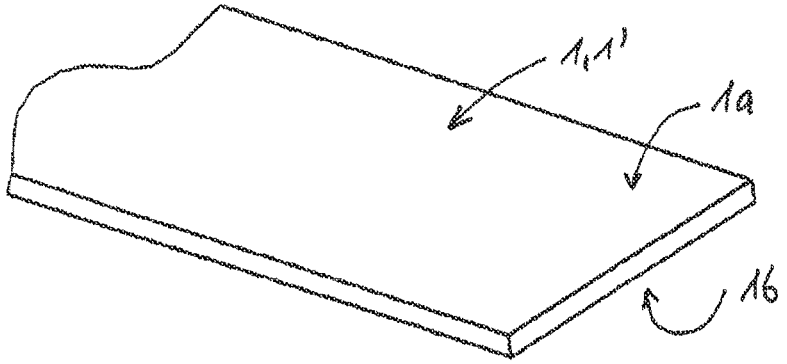

non-flanged material edge (101). Within the material edge (101), the self-clinching bolt (5) is press-fit with a peripheral area of the bolt body (9) thereof, thus creating a force fit.

18 Claims, 7 Drawing Sheets

(51) Int. Cl.

| | |
|---|---|
| ***H01R 9/05*** | (2006.01) |
| ***H01R 43/02*** | (2006.01) |
| *H01R 4/10* | (2006.01) |
| *H01R 12/58* | (2011.01) |
| *H01Q 1/12* | (2006.01) |
| *H01R 101/00* | (2006.01) |

(52) U.S. Cl.
CPC ..... *H01R 4/023* (2013.01); *H01R 4/10* (2013.01); *H01R 12/58* (2013.01); *H01R 2101/00* (2013.01); *H01R 2201/00* (2013.01); *Y10T 29/49179* (2015.01)

(58) Field of Classification Search
USPC ..... 343/853
See application file for complete search history.

(56) References Cited

U.S. PATENT DOCUMENTS

2008/0229570 A1 9/2008 Koppitz et al.
2008/0268708 A1* 10/2008 Yamada ..... H01R 13/514 439/607.01
2010/0072587 A1* 3/2010 Naito ..... G01R 1/0458 257/675
2010/0093197 A1* 4/2010 Sander ..... H01R 12/585 439/82
2011/0053412 A1 3/2011 Johnson
2011/0097142 A1 4/2011 Bassler et al.
2013/0267115 A1* 10/2013 Mark ..... H01R 13/00 439/485
2013/0286618 A1* 10/2013 Shibasaki ..... H01L 23/049 361/772

FOREIGN PATENT DOCUMENTS

| | | |
|---|---|---|
| DE | 69 40 677 | 10/1969 |
| DE | 102 59 803 | 5/2004 |
| DE | 10 2005 047 975 | 4/2007 |
| DE | 20 2006 020 456 | 10/2008 |
| DE | 10 2007 057 501 | 6/2009 |
| WO | WO 2005/079127 | 8/2005 |
| WO | 2011/009850 A1 | 1/2011 |

OTHER PUBLICATIONS

English translation of the International Preliminary Report on Patentability and Written Opinion of the International Searching Authority mailed Jul. 3, 2014, issued in International Application No. PCT/EP2012/005315.

* cited by examiner

ELECTRICAL CONNECTION DEVICE FOR PRODUCING A SOLDER CONNECTION AND METHOD FOR THE PRODUCTION THEREOF

This application is the U.S. national phase of International Application No. PCT/EP2012/005315, filed 20 Dec. 2012, which designated the U.S. and claims priority to DE Application No. 10 2011 122 371.5, filed 22 Dec. 2011, the entire contents of each of which are hereby incorporated by reference.

The invention relates to an electrical connection device for producing a solder connection in accordance with the preamble of claim 1 and to a method for the production thereof according to claim 17.

Solder connections are among the most common connection types in the field of electrical and electronic devices.

However, there are also applications in which for example an electrical connection is to be provided between connecting wires or, generally speaking, connecting lines on the one hand and electrically conductive contact elements on the other hand, which consist for example of non-solderable materials. This may for example include strip conductors, which may be provided on a plate-shaped substrate, or, generally speaking plate-shaped conductors in the form of metal sheets or metal strips etc.

This leads to the question of how to produce a permanent electrically solderable connection from a highly electrically conductive material or metal to a strip line of this type or to another conductor consisting of non-solderable material.

Non-solderable strip conductors are often used in the form of thin-walled metal sheets which may for example be mounted on dielectric carrier material. By contrast, the strip conductors or strip lines may also be mounted in front of a metal surface, using air as a dielectric. In particular in mobile communications technology, strip conductors are often used which are mounted at a distance in front of an electrically conductive metal reflector sheet and held by means of an insulating body mounted on the metal reflector sheet. Subsequently, an electrical connection for example must optionally be produced using copper wires etc. if necessary. It would be advantageous if easily solderable connection wires of this type could be soldered onto the strip conductors.

In this regard, reference is made purely by way of example to DE 10 2005 047 957 A1, the content of which corresponds to U.S. Pat. No. 7,358,924 B2. This document discloses capacitive coupling devices which are arranged at a distance in front of a metal reflector sheet, using air, and in this context, as stated, junctions have to be soldered to the strip lines.

Galvanic contacts are equally known, in which for example two conductor plates or conductor paths are screwed together.

A method and a device for fastening an insert in a plate material are known for example from CH 383 082. A metal, sheet metal or insulating material which is plate-shaped in form is taken as a starting point. A cylindrical insert, which is provided with a knurling on the outer circumference thereof in the axial direction over part of the height thereof, is to be pressed into this plate. By means of a pressing tool, in ether words a punch and a cylindrical hollow punch which serves as a counter brace, the cylindrical insert can subsequently be pressed forwards towards the plate, a cylindrical material portion of the plate being punched out by the hollow punch, whereupon the cylindrical insert can subsequently be pressed in. The outer circumference of the insert basically corresponds to tie internal diameter of the cylindrical punched-out hole, merely the knurling of the insert possibly having a slightly greater external diameter, so as to be able to notch the axially extending flanks of the knurling into the surface of the cylindrical recess in the plate during joining. This should ensure a good press fit.

A solution which is comparable in this regard is also known from DE 10 2007 057 501 A1. In this case too, a press-in connection is proposed, using a bolt which has an external contour, preferably in the form of a knurling, and of which the surface formation, which is correspondingly matched in terms of its diameter, is adapted to a hole in a busbar.

The anchoring of a two-stage insertion element having an external knurling in a stepped arrangement and of a correspondingly stepped recess of a wall portion of a housing wall is known from DE 102 59 803 B3. In this case too, the cooperation of the knurling on the outer circumference and the internal surface of the stepped hole are to ensure an optimal press fit brought about by notching.

In the device known from DE 20 2006 020 456 U1 for producing an electrically conductive connection, a contact plug is proposed, which can be inserted into a corresponding hole in an electrically conductive counter piece.

By contrast, the object of the present invention is to provide an option for producing a good electrical connection between solderable and non-solderable or only poorly solderable materials, specifically in a simple and cost-effective manner. Above all, it should be ensured that intermodulation-stable and intermodulation-free electrical connections can be provided.

The object is achieved in relation to a connection device by the feature specified in claim 1 and in relation to a corresponding production method for a connection device of this type by the features specified in claim 17. Advantageous embodiments of the invention are given in the dependant claims.

It can be considered extremely surprising that within the context of the invention an optimum electrical connection between solderable and non-solderable materials can be produced using comparatively simple measures.

According to the invention, this is achieved by using what are known as press-in bolts which consist of a solderable material and are pressed into strip-shaped or plate-shaped materials which themselves are non-solderable or only extremely poorly solderable.

These press-in bolts comprise a punch-shaped connection face on which a solder connection can be produced. The press-in bolt is pressed through a plate-shaped non-solderable material in the manner of a punch, causing a hole to be made through the non-solderable material, such as in particular strip conductor material, which gains a broken-up circumferential material rim in the region of the penetration by the press-in bolt. This material rim holds a base circumferential region of the press-in bolt, achieving high press-in and gripping forces, the head of the press-in bolt projecting beyond this bordered strip conductor material rim and being available as a soldering point.

The grip portion on the circumferential rim of the press-in bolt, which cooperates with the circumferential material rim, broken up during the press-in, of the non-solderable plate material and holds the press-in bolt, may preferably be provided with a circumferential knurling. This produces an excellent non-positive connection between the well material of the press-in bolt and the adjacent non-solderable material.

Finally, the press-in bolt is used as a pressing or embossing stamp, so as to deform a corresponding plate-shaped material, the press-in bolt thus effectively being left behind in the non-solderable material after penetrating it.

Another advantage of this is that the corresponding deformation of the non-solderable material is provided by the press-in bolt itself, in such a way that there is ultimately no tolerance-induced mismatch between the external and internal part of the press connection.

A clean circumferential material portion, which is bent up during the press-in process of the press-in bolt and is positioned against the outer circumference of the press-in bolt, is formed in that a hole or punching is initially formed, preferably at the relevant point in the strip-shaped or plate-shaped material, and forms the centre for pressing in the press-in bolt.

The bordered material rim, which occurs when the press-in bolt is pressed in and projects beyond the thickness of the plate-shaped material, simultaneously also serves to prevent tilting of the press-in bolt. This is because the bordered material rim holds the bolt in a press fit with a relatively large total area of the material rim enclosing it. Otherwise, for thin metal sheets the penetration in the plate material would be critical since otherwise the bolt could tilt more easily in the event of laterally applied tensile or compressive forces. The solution according to the invention thus greatly improves the long-term stability in the event of radial tensile or compressive loads.

The electrical connection formed in this manner is also suitable above all for connecting coaxial cables, it being possible to achieve particularly good solder connections even if the press-in bolt is for example tin-plated or silver-plated or for example consists of brass etc.

Any oxide layers which may be present on the surface of the non-solderable material are ultimately not obstructive since pressing in the press-in bolt and deforming the non-solderable material leads to a self-cleaning effect, and in particular for knurled press-in bolts this knurling notches and cuts into the non-solderable material even better.

In a development of the invention, it is also possible for the press-in bolt to be provided in the circumferential direction with at least one circumferential depression or groove, which may be formed concave in the axial vertical section for example (different cross-section formations of this groove being possible). Likewise, it is also possible for example for two circumferential grooves of this type on the outer circumference of the press-in bolt to be provided, which are mutually offset in axial height. When compressed, this at least one groove or the plurality of grooves should come to be positioned in the region of the material thickness of the plate-shaped or sheet-shaped material. One result of this formation is that an even greater contact pressure between the plate-shaped or sheet-shaped material and the circumferential surface of the press-in bolt is ensured in the remaining contact region, meaning that potential intermodulations can be prevented even better and more reliably.

The invention can be used in all relevant fields in which electrically solderable and electrically non-solderable materials are to be soldered together. This applies in particular in the case of a solder connection for highly electrically conductive materials such as coaxial internal conductors comprising strip conductors.

Figure 1B:
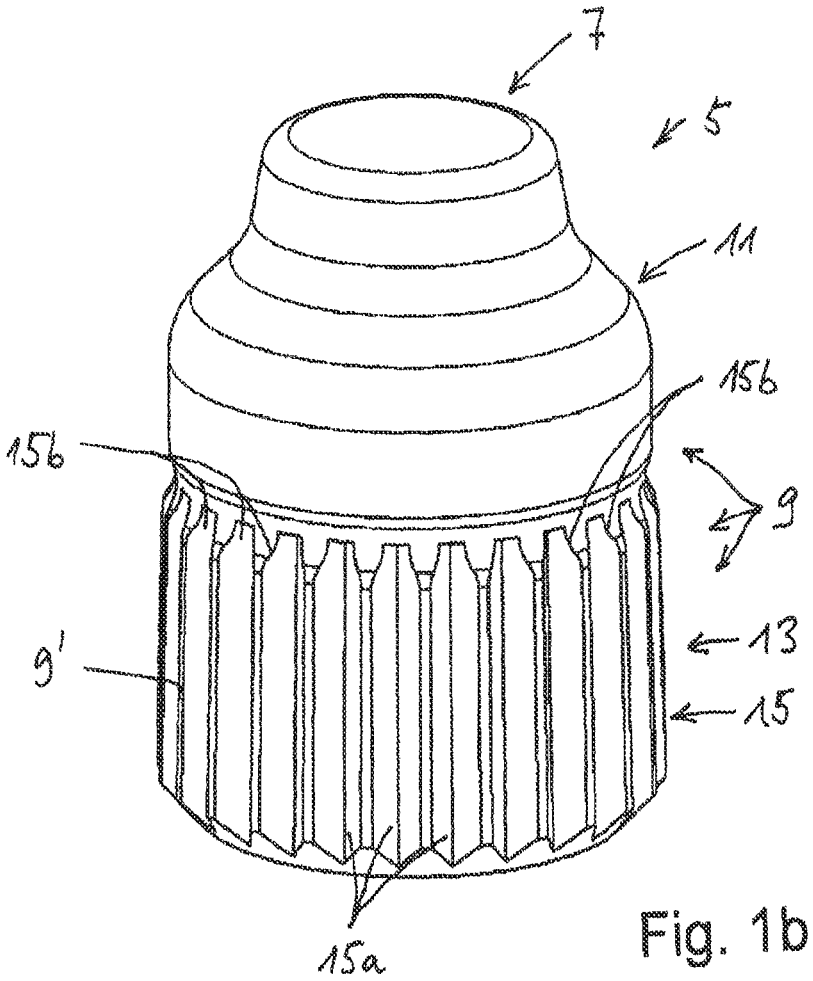
Figure 1C:
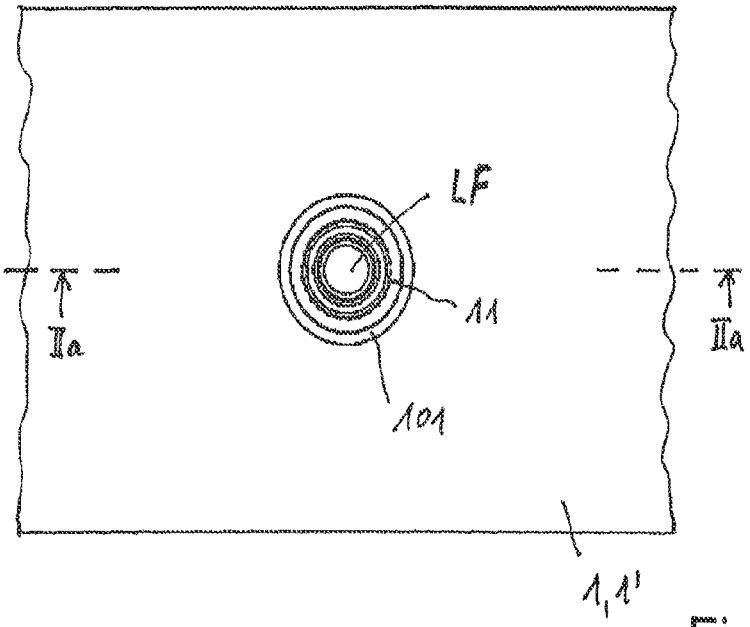
Figure 2A:
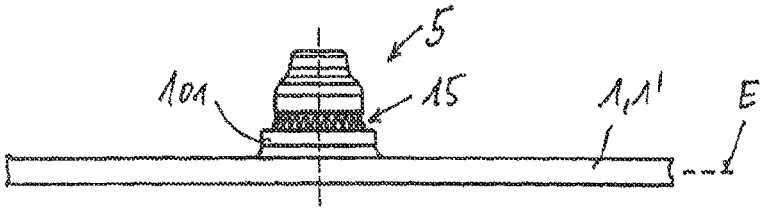

In the following, the invention is described in greater detail by way of drawings, in which, in detail:

FIG. 1*a* is a schematic three-dimensional drawing of a plate-shaped or strip-shaped material, which is electrically non-solderable or poorly solderable end to which an easily electrically solderable conductor is to be electrically connected;

FIG. 1*b* is a schematic three-dimensional drawing of a press-in bolt which serves as a basis for producing an easily solderable electrical connection;

FIG. 1*c* is a plan view of the strip-shaped or plate-shaped conductor shown in FIG. 1 together with the press-in bolt pressed into it;

FIG. 2*a* is a corresponding side view of the embodiment of FIG. 1*c;*

Figure 2B:
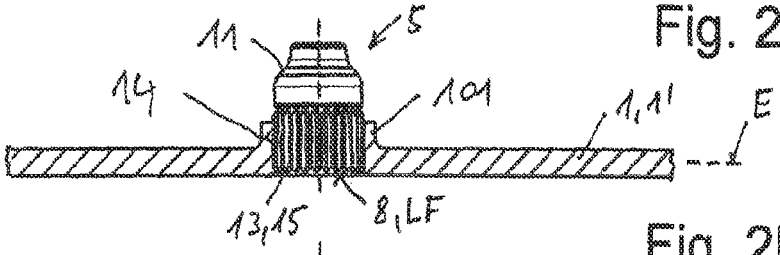
Figure 2C:
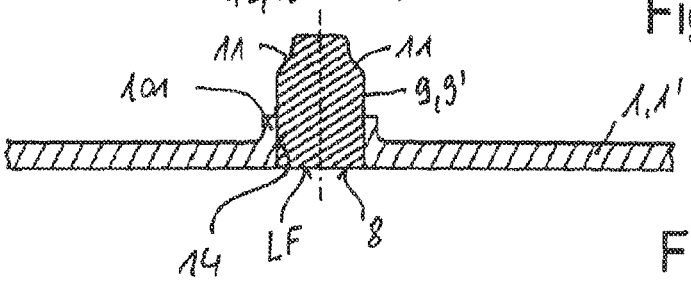
Figure 3:
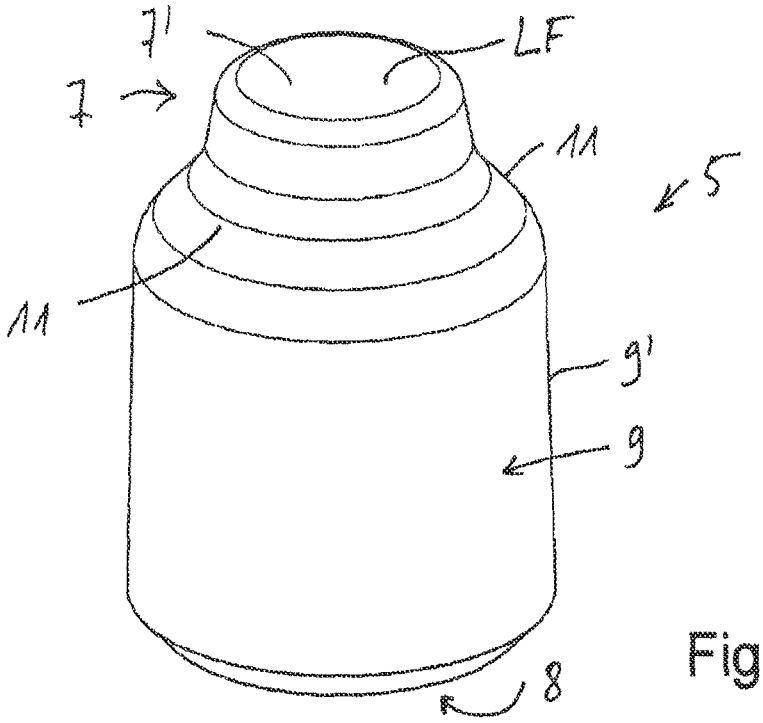
Figure 4A:
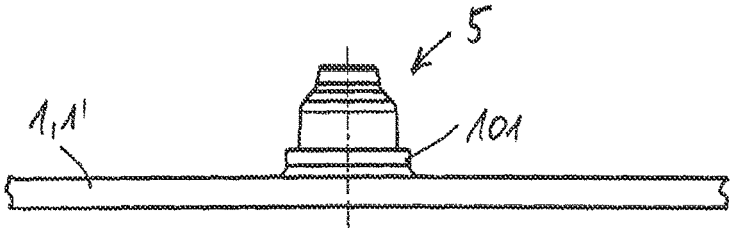
Figure 4B:
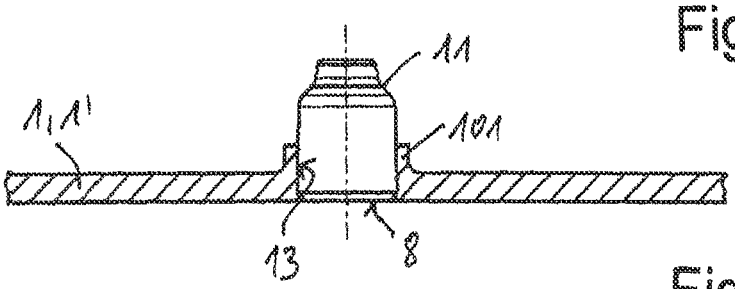
Figure 4C:
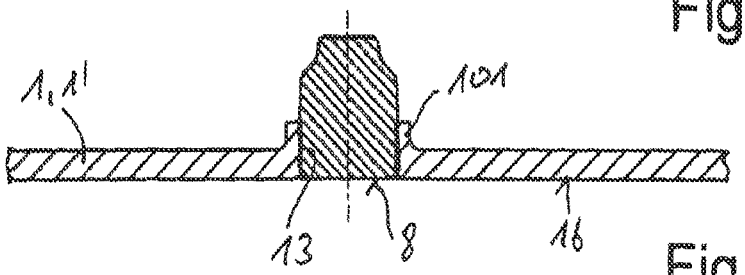
Figure 5:
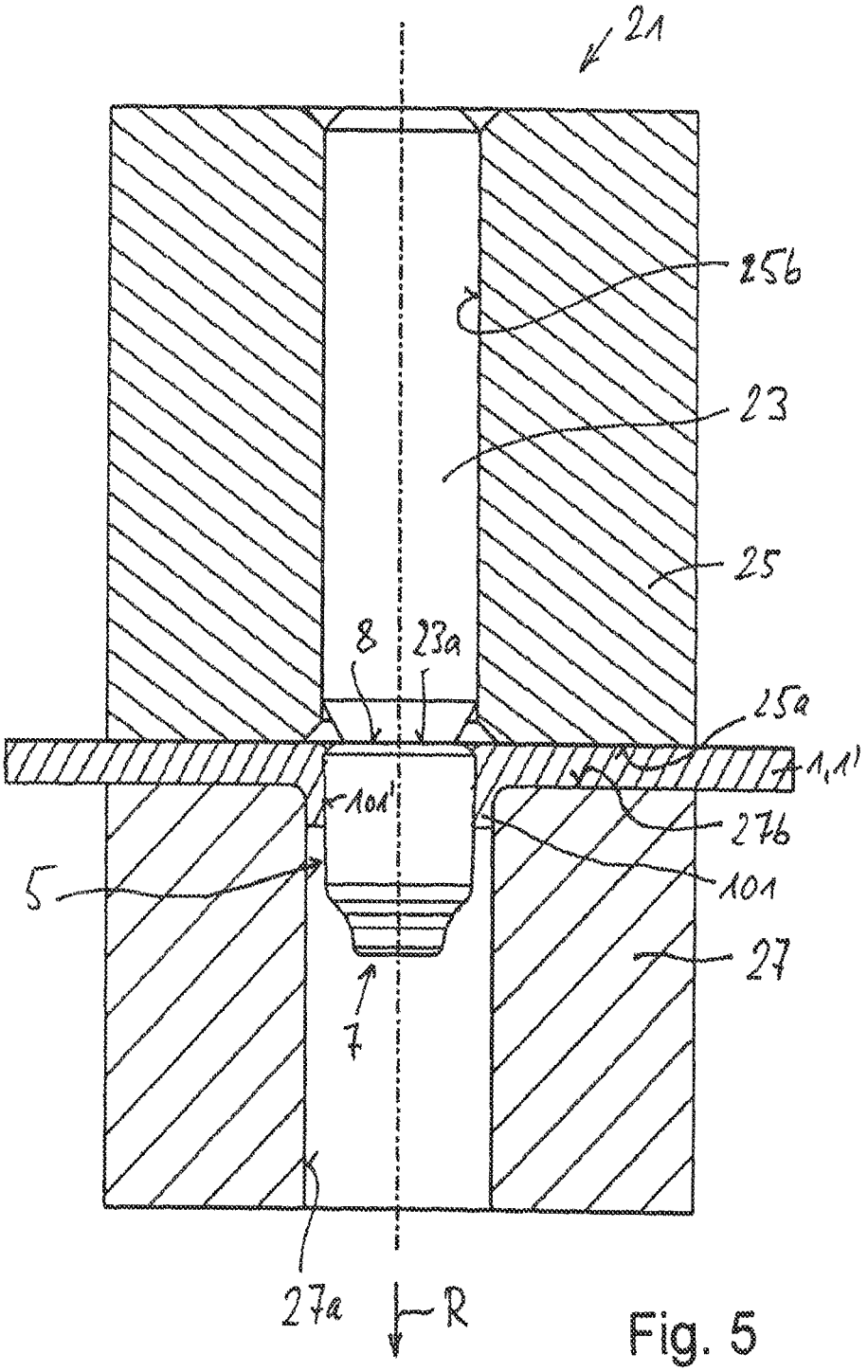
Figure 6A:
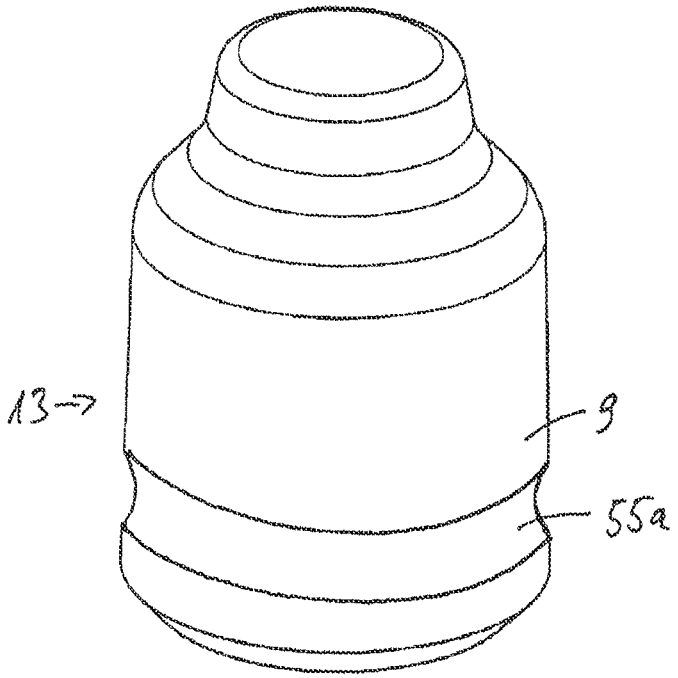
Figure 6B:
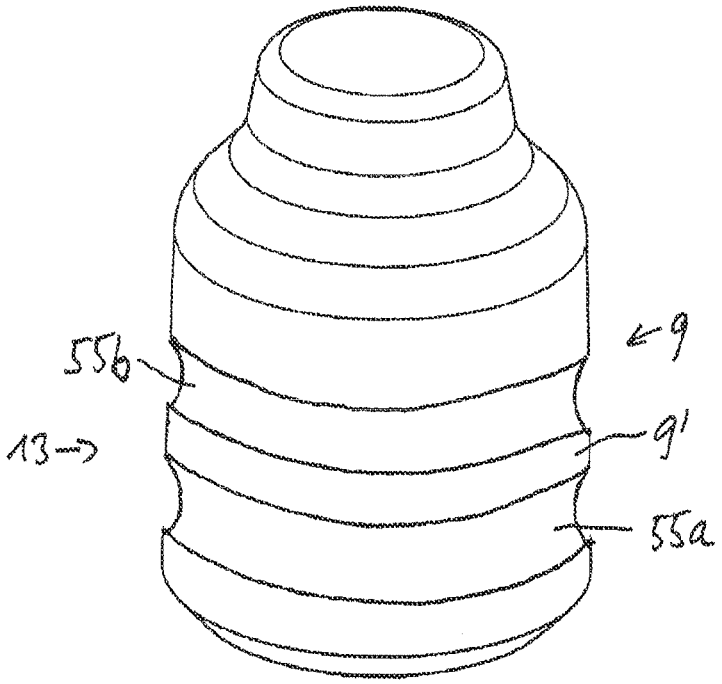
Figure 7:
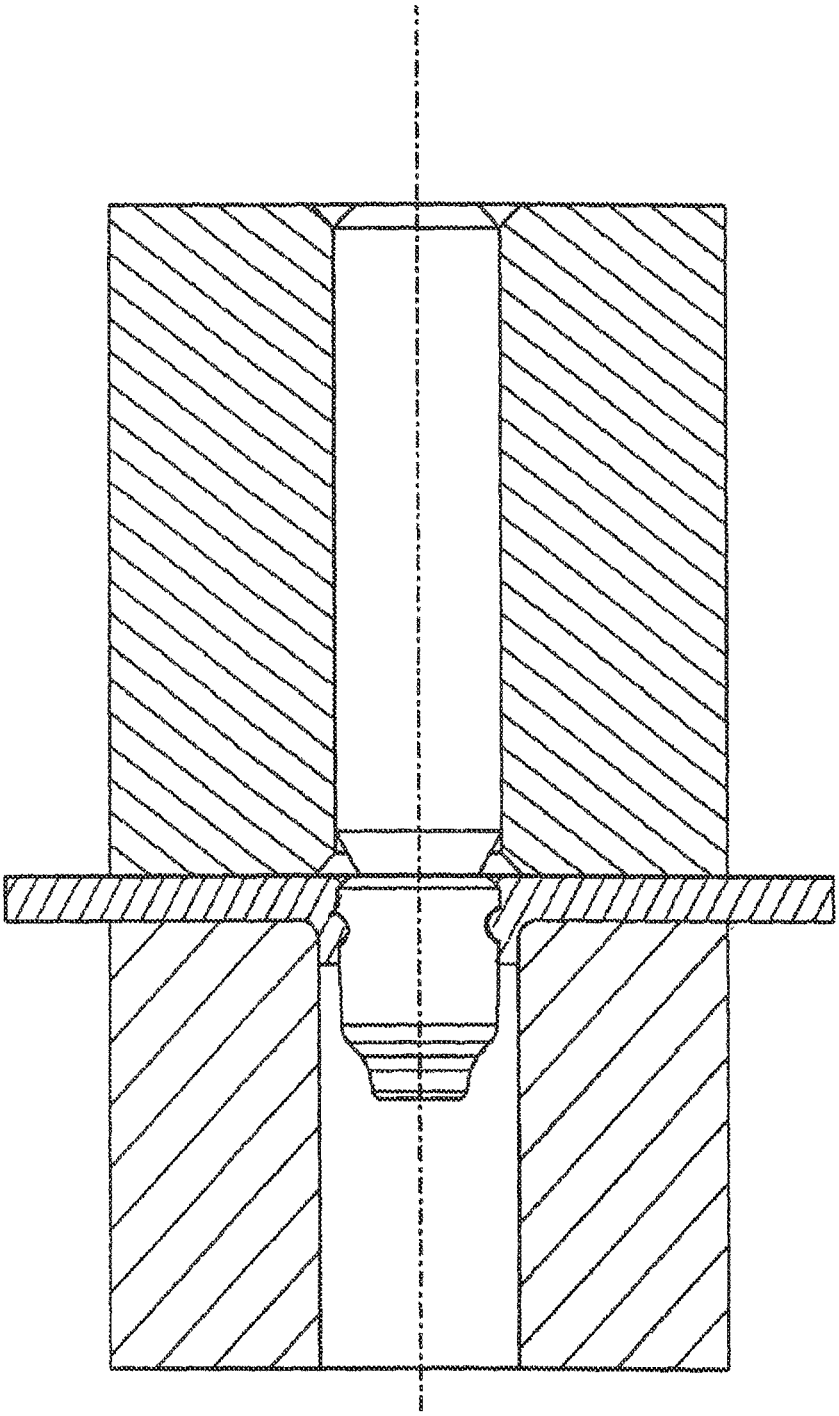
Figure 8A:
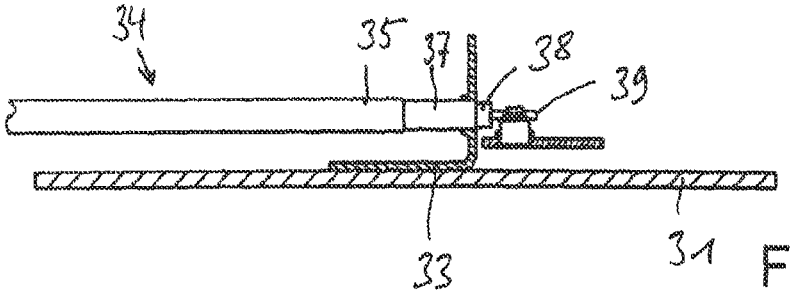
Figure 8B:
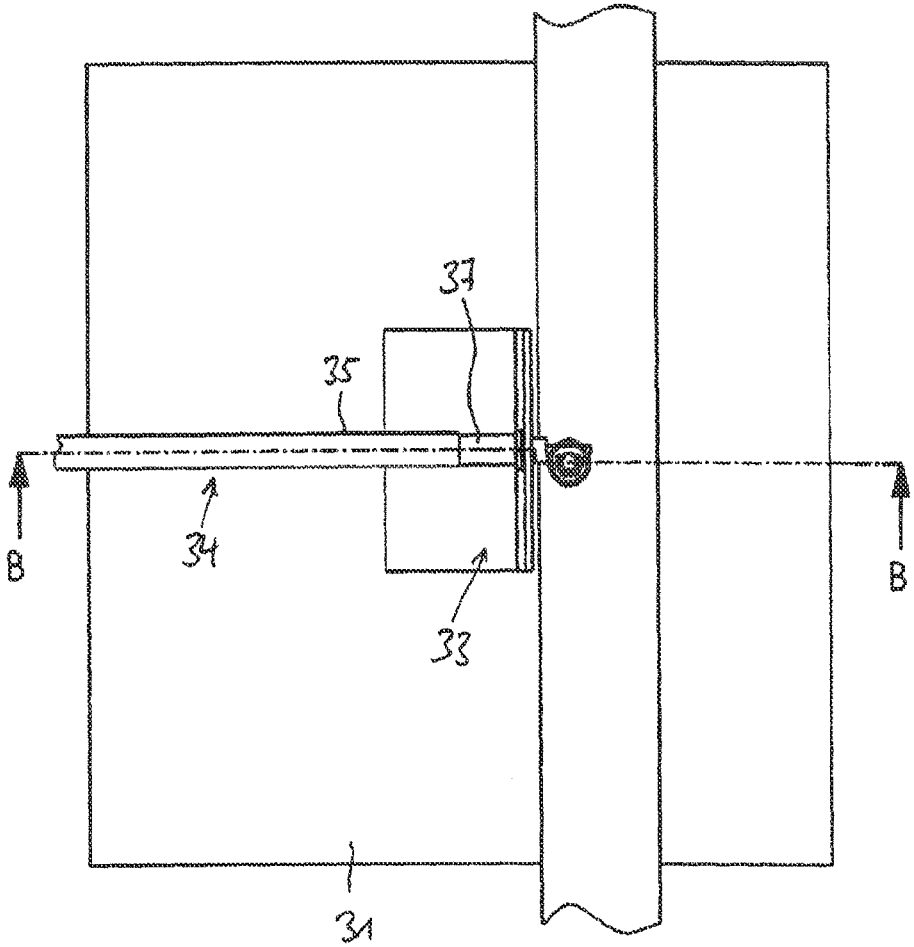

FIG. 2*b* is a corresponding side view similar to FIG. 2*a*, in section in part along the line IIa-IIa of FIG. 1*c*, with a corresponding side view of the press-in bolt;

FIG. 2*c* is a sectional view along the line IIa-IIa in FIG. 1*c*, showing the press-in bolt in axial section;

FIG. 3 is a schematic perspective view of a press-in bolt differing from that in FIG. 1*b*, which is formed without knurling an the outer circumference thereof;

FIGS. 4*a* to 4*c* are drawings correspond to FIGS. 2*a* to 3*c*, but for a press-in bolt without knurling on the outer circumference thereof, as shown in FIG. 3;

FIG. 5 is a schematic cross-section through a pressing tool, illustrating how the press-in bolt is pressed into the strip-shaped or plate-shaped material;

FIGS. 6*a* and 6*b* show two modified embodiments of a press-in bolt, which unlike the embodiment of FIG. 3 comprises one or two circumferential grooves on the outer circumference thereof;

FIG. 7 is an embodiment modified from FIG. 5 using a press-in bolt according to FIG. 6*a;* and FIGS. 8*a* and 8*b* are a schematic cross-section and a schematic plan view of an application, illustrating how the internal conductor of a coaxial cable comprising a strip conductor is soldered in a solder connection, using an interposed press-in bolt according to the invention.

FIG. 1*a* is a partially schematic plan view of an electrically non-solderable plate-shaped or strip-shaped material 1, referred to in the following as a strip conductor 1' for short. The invention deals with producing a solderable electrical connection to a strip-shaped or plate-shaped conductor 1 of this type, which consists with a non-solderable material or at least of a poorly solderable material or is at least covered and/or coated with a material of this type.

The term "strip conductor" is used as representative of all plate-shaped or strip-shaped materials 1 for which a solder connection to another, easily solderable, conductor is to be produced.

Further, FIG. 1*b* is a schematic three-dimensional drawing of a press-in bolt 5 which is used in the present invention to produce an easily electrically solderable connection. Finally, FIG. 1*c* is a plan view of the plate-shaped or strip-shaped material 1, in particular in the form of a strip-conductor 1', specifically with a plan view of the head, which is positioned above and will be discussed further in the following, of the press-in bolt 5 which penetrates the plate-shaped or strip-shaped material 1.

FIGS. 2*a* to 2*c* are views parallel to the plane of the strip conductor 1', in FIG. 2*a* specifically in the uncut state (in other words in the viewing direction corresponding to arrow IIa in FIG. 1*c*), in a cross-section transverse to the line IIc-IIc in FIG. 1*c*, FIG. 2*b* being a corresponding drawing but one in which a press-in bolt 5 penetrating the strip conductor 1' is shown in the uncut state.

From FIG. 1*b*, it can be seen that the press-in bolt 5 comprises a solderable bolt head 7. In particular having an end face 7' which has a tapered cross-section by comparison with the bolt body 9 located below it. By way of the flattened shoulders thereof, the bolt head 7 transitions info the bolt body 9 which is of a greater diameter than the bolt bead 7.

Preferably, not only the end face 7' or else the flattened shoulder region adjacent thereto, of the bolt head 7 should be easily solderable, but preferably the entire bolt head 7, including the upper end face 7' thereof and the flattened shoulders 11 adjacent thereto since the press-in bolt 5 consists of an easily solderable material, or is at least covered with an easily solderable material in this region, ex works.

Below the shoulder region 11, there is a press fit 13 between the press-in bolt 5 and the strip conductor 1'. In the embodiment of FIGS. 1*b* and 2*a* to 2*c*, the bolt body 9 has an outer circumference 9', at least in the region of the press fit 13 thereof, which outer circumference is provided with a knurling 15. The knurling 15 comprises a plurality of ribs 15*a*, which extend in the axial, longitudinal direction and are mutually offset in parallel in the circumferential direction, and which project radially and ensure a particularly rigid press fit 13 to the circumferential material rim 101 of the plate-shaped or strip shaped electrically non-solderable or electrically poorly solderable material 1.

Apart from the knurling 15 shown in FIG. 1*b*, extending in the axial, longitudinal direction, in principle any knurling of another form may be used, for example a knurling which is provided with ribs extending in a cross (cross-knurling) or a knurling which extends helically around the outer circumference 9' of the bolt body 9, only provided with ribs formed in sub-portions, etc. There are no fundamental restrictions as regards particular types and shapes of knurling.

The ribs 15*a*, shown in FIG. 1, of the knurling 15 have a wedge-shaped or wedge-like shaping 15*b* on the sides thereof facing the bolt head 7, in other words increasingly taper. This facilitates the press-in movement, explained further in the following, into the material 1.

Thus, as stated, the solderable bolt head 7, which has a solderable area LF on the upper face thereof, ultimately comes to be positioned at a distance from the plane of the plate-shaped or strip-shaped material 1, specifically on one side 1*a* of the plate-shaped or strip-shaped material 1, on which a material rim 101 also projects more or less perpendicular to the plane E of the plate-shaped or strip-shaped material 1, 1'. This generally circumferential material rim 101 is connected to the plate-shaped or strip-shaped material 1, 1'. In a material fit, and occurs during the production process, explained further in the following, by deforming a material portion of the plate-shaped or strip-shaped material 1, 1'. This material rim 101 is thus biased on the outer circumference 9' of the press-in bolt 5 at a fixed bias, bringing about the desired press fit 13.

Although this is not shown in greater detail, the underside or base 8 of the press-in bolt 5 may also be solderable (if for example the press-in bolt 5 consists of an easily solderable material or is covered with an easily solderable material) or comprises a solderable, in other words easily solderable, area LF as an alternative or in addition to the solderable bolt head 7, at least on the underside or base face 8 thereof. Finally, it should at this point be noted for completeness that the press-in bolt need not be worked into the plate-shaped or strip-shaped material 1,1' to form a through-opening 14 in such a way that the underside or base face 8 thereof is flush with the underside 1*b* of the plate-shaped or strip-shaped material 1, 1'. Rather, it would also be possible for the underside or base face 8 to project even further downwards beyond the plane E of the plate-shaped or strip-shaped material 1, 1'. It is actually undesirable for the press-in bolt to be slid in so far that the underside or base face 8 thereof comes to be positioned above the plane E of the plate-shaped or strip-shaped material 1, 1' in which the press-in bolt may still be held by the material rim 101 since the contact forces between the material rim 101 and the outer circumference 9' of the bolt body decrease in this case.

The embodiment of FIGS. 3 and 4*a* to 4*c* corresponds to the embodiment described above, with the difference that the press-in bolt 5 is not provided with a knurling 15 in the region of its press fit 13, but instead has a more or less smooth outer circumference 9', as can also be seen in particular from the perspective drawing of FIG. 3.

By way of FIG. 5, it is described in the following how the connection of the bolt body 9 to the strip conductor 1' is produced.

For this purpose, a pressing tool 21 having en upwardly positioned stamp 23 is used, which in the embodiment shown is cylindrical in form and is enclosed by a tubular outer stamp or hold-down device 26. Further, a tubular die 27, in other words a die 27 having a central recess 27*a*, is arranged underneath.

To produce the desired connection, corresponding material portions of the plate-shaped or strip-shaped, electrically non-conductive or poorly conductive material 1, for example in the form of the aforementioned strip conductor 1', are laid on the die. The hold-down device 25 is moved away into the position shown in FIG. 5, in such a way that the plate-shaped or strip-shaped material 1, 1' is held gripped between the end face or pressing face 25*a* of the outer tubular hold-down device 25 and the pressing face or contact face 27*b* of the die 27.

With the somewhat tapered bolt head 7 thereof facing towards the die 27, the aforementioned press-in bolt 5 is inserted into the axially extending central hole 25*b* of the hold-down device 25. Subsequently, the actual stamp 23 is pressed from top to bottom, in the drawing of FIG. 5, in the interior 25*b* of the tubular hold-down device 25, the leading pressing face or end face 23*a* of the punch 23 being positioned on the underside or base face 8 of the press-in bolt 5 and pressing the press-in bolt 5 into the still closed material 1, 1' with high pressing forces. It corresponding high pressures are used, the material 1, 1' thus tears, the press-in bolt 8 being advanced further through the punch 23 until its end position shown in FIG. 5, whereupon the stamp movement is subsequently stopped.

During the press-in process and the tearing of the strip-conductor material, as a result of the high pressing forces in conjunction with the cylindrical internal wall 27*a* in the recess 27*a* of the die 27, a circumferential material rim 101 is formed, which is increasingly widened further during the continuing press-in movement of the press-in bolt until the end position thereof shown in FIG. 5.

So as to prevent a crater-shaped tear in the material rim 101 which interacts with the bolt body 9, in other words with the outer circumference 9' of the press-in bolt 5, before the press-in bolt is pressed in a corresponding centring opening or centring hole is preferably formed in the plate-shaped or strip-shaped material 1, 1' at the point where the press-in bolt 5 is to be pressed in. The opening in the plate-shaped or strip-shaped material 1, 1' should preferably be of a diameter which is larger than the optionally leading head 7 which is preferably planar in form. In other words, the press-in bolt should be formed in such a way that it engages with the pre-punched or pre-formed opening in the material 1, 1' as early as the diameter region thereof comprising a flank 11 which descends conically or in a shoulder shape. Therefore, all portions in which the press-in bolt 5 transitions from a smaller diameter to a larger diameter are preferably conical in the press-in direction R (FIG. 5), in other words formed wedge-shaped in section. The starting knurling also comprises conical leading flanks 15*b* in the press-in direction R, which subsequently transition into the corresponding remaining portion, which may also still widen conically slightly, of the ribs 15*a* of the knurling 15.

In particular if the bolt body 9 is provided with the circumferential knurling 15 in the region of the press fit 13, this results in a particularly rigid and intensive press fit, producing a good electrical connection, between the bolt body 9 and the electrically non-conductive material 1.

So as thus to improve the deformation of the material 1, 1' and prevent torn-out crater formation in the region of the enclosing material rim 101, the material is perforated in advance at the relevant point where the bolt body 9 is pressed into the material 1, 1', it being possible to optimise the size of this advance perforation as a function of the material. The faces of the bolt body 9 are conical or slightly conical in portions at least in the axial direction, in particular as a result of the formation of the aforementioned shoulders 11 and/or ribs 15*a*.

The materials used as the material 1, 1' end for the bolt body 9 may be self-inhibiting or comprise at least one self-inhibiting surface. The bolt body may consist of bronze, be tin-coated or for example silver-coated etc.

If the plate-shaped or strip-shaped material 1 is additionally heated before the press-in bolt 5 is introduced, during the subsequent cooling an additional shrinking effect in the material 1, 1' can contribute to the enclosing materiel rim 101 being positioned on the outer circumference of the bolt body 9 in the region of the press fit 13 thereof with an even greater pressing effect. Likewise, alternatively or in addition, the press-in bolt 5 could be cooled before the press-in bolt is introduced, in such a way that the press fit is improved after the press-in bolt 5 is introduced into the material 1, 1' in that the material of the press-in bolt 5 is likewise improved by the expansion process of the press-in bolt.

FIGS. 6*a* and 6*b* show two modifications of the press-in bolt 5.

In the variant of FIG. 6*a*, a circumferential groove 55*a*, which may for example have concave shaping in axial vertical section, is formed in the region of the press fit 13, in other words on the outer circumference 9' of the bolt body 9. However, a different cross-section may thus also be used, for example a U-shaped cross-section, comprising groove walls extending perpendicular to or oblique with respect to the floor of the groove. In the variant of FIG. 6*b*, two circumferential grooves 55*a* and 55*b* of this type are provided with a mutual axial offset in the region of the press fit 13 on the outer circumference 9' of the press-in body 9. This has the result, as is shown in FIG. 7 by contrast with the embodiment of FIG. 5, that during the press-in process of the press-in bolt into the material 1, 1', during the application of the high pressing forces, as a result of the deformation taking place, part of the material 1, 1' may flow into these one or two grove-shaped depressions or recesses 55*a* and 55*b*, and thus not only a stable and rigid press fit, and therefore not just a non-positive, but above all also a positive connection can be produced between the material 1, 1' and the press-in bolt 5. Thus, in the remaining pressing region between the outer circumference 9' of the bolt 5 and the internal wall 101', even higher pressing forces can be achieved in this press fit 13, meaning that both on the upper side 1*a* and on the underside 1*b* a better electro-galvanic transition to the press-in bolt 5 is produced. This further reduces the risk of undesired intermodulations occurring.

Merely for completeness, FIG. 8 is a cross-section and FIG. 8*b* is a corresponding plan view showing how a coaxial cable 34 is held and anchored in front of a metal sheet, a detail of which is shown in cross-section, for example a reflector in a mobile communications antenna for a base station on an angle bracket 33, for example in the form of a soldered-on lug, the insulating coating 35 of the coaxial cable 34 being correspondingly removed at the end, in such a way that the bare external conductor 37 underneath it is connected for example to the highly electrically conductive angle bracket 33 and moreover is connected to the metal reflector sheet 31 in a highly electrically conductive manner.

Via the end face of the end of the external conductor 37 and the dielectric 38 located underneath it between the external and the internal conductor, the internal conductor 39 thus projects at the end face beyond the coaxial cable end which has been removed in this manner, and thus comes to be positioned for example in a parallel position with respect to the plate-shaped or strip-shaped material 1, in particular in the form of a strip conductor 1', and may be soldered by its free end on an easily electrically solderable press-in bolt 5 projecting transverse to the material 1 or strip conductor 1', on the bolt head 7 thereof, for example being applied not to the upper side 7 of the head, but rather in the region of the shoulder portion 11 which is likewise easily solderable.

This embodiment also shows that not only the uppermost planar face of the bolt head 7, but also the shoulder region 11 adjacent thereto of the press-in bolt 5 may be equipped with an easily solderable surface LF ex works, so as easily to be able to solder an electrical line not only to the uppermost end face 7' of the bolt head 7 but also optionally in the shoulder region 11 thereof.

Within the context of the invention, various strip-shaped or plate-shaped conductors 1, 1' may be used. The thickness range of these strip-shaped or plate-shaped conductors 1, 1' may also be selected differently within wide ranges, as long as appropriate working-in within the context of the invention is possible. In particular, the press-in bolt 13 may be used for conductors 1 which are of a thickness of as much as 5 mm, 8 mm, 8 mm, 9 mm or even 10 mm. Plates having a thickness range of less than 4 mm, in particular less than 3 mm or 2 mm, are likewise possible.

However, the invention may equally be used for very thin, sheet-shaped conductors and plates, for example plates in the form of metal sheets which are of a thickness of 0.4 mm or more, in particular a thickness of at least 0.5 mm, 0.6 mm, 0.7 mm, 0,8 mm, 0.9 mm or 1 mm. Thus, above all the invention can still be implemented optimally not only in ranges of 0.4 mm, but in particular of approximately 1 mm to 2 mm plate or sheet thickness. All electrically conductive plate-shaped or strip-conductor-shaped plates or metal sheets are possible, which for example are produced by a rolling method, are produced as a die-cast part, consist of an extrusion-moulded pad, or are produced using other machining steps including sawing, punching and deformation. There are no restrictions in this regard.

The press-in bolt may consist of any suitable materials. In particular, materials such as brass, copper and bronze are suitable for this purpose.

It can thus be seen from the description and drawings that the press-in bolt 5 comprises a bolt head 7 which is of a much smaller diameter then the circumferential boundary surface, in other words is of a smaller diameter then the circumferential surface of the bolt body 9.

The circumferential boundary surface or the circumferential surface of the bolt body 9 may be smooth or be provided with a knurling which projects radially even further beyond the diameter of the bolt head 7. In this way, a preferably continuous transition from the bolt head 7 via increasingly widening flank-shaped shoulders 11 into the actual bolt body 9 is provided. This makes it possible for the corresponding plate material to be deformed during the penetration of the press-in bolt 5 by way of the interaction with the increasingly widening shoulder of a flank-shaped configuration, specifically so as to form a material rim 101 projecting transverse to the plate material. The bordered materiel rim 101 (in other words the entire height of the bordered material rim 101 including the thickness of the plate-shaped or strip-shaped material 1, 1') may be of a height which is greater than 1.1, 1.2, 1.3, 1.4, 1.5 1.6, 1.7, 1.8, 1.9, 2.0, 2.1, 2.2, 2.3, 2.4, 2.5, 2.6, 2.7, 2.8, 2.9, 3.0 times the thickness of the plate-shaped or strip-shaped material 1, 1'. In other words, a configuration is generally favourable and sufficient if the total height of the bordered material rim 101 (including the thickness of the plate-shaped and strip-shaped material) is not greater than 3.0, 2.9, 2.8, 2.7, 2.6, 2.5, 2.4, 2.3, 2.2, 2.1, 2.0, 1.9, 1.8, 1.7, 1.6, 1.5 times the thickness of the plate-shaped or strip-shaped material 1, 1'.

The press-in bolt 5 may also be formed with different dimensions within wide ranges.

Preferably, the press-in bolt 5 is dimensioned in such a way that the diameter in the region of the bolt body 9 thereof is for example between 1.5 and 7 mm, and preferably has a diameter which is greater than 2.0 mm, 2.5 mm, 3.25 mm, 3.5 mm, 3.75 mm, 4.0 mm, 4.25 mm, 4.5 mm, 4.75 mm or is greater than 5.0 mm. Further, for many applications it is sufficient if the external diameter of the bolt body 9 is not greater than 8.0 mm, in particular being less than 7.5 mm, 7.0 mm, 6.5 mm, 5.0 mm, 4.75 mm, 4.5 mm, 4.25 mm, 4.0 mm, 3.75 mm, 3.5 mm and in particular less than 3.0 mm.

The axial length or height of the press-in bolt 5 may likewise be selected differently within wide ranges. Preferably, the axial length of the press-in bolt 6 is a dimension corresponding to at least 1.5 times the thickness of the plate-shaped or strip-shaped material 1, 1'. Preferably, the axial height of the press-in bolt 5 is at least 2, 3, 4, 4.5 or approximately 5 times as greet as the thickness of the plate-shaped or strip-shaped materiel 1, 1'. On the other hand, it is generally sufficient if the axial length or height at the press-in bolt 5 is not greater than 10 times the thickness of the plate-shaped or strip-shaped material 1, 1', in particular not greater than 9, 7, 6 or 6.5 times the thickness of the plats-shaped or strip-shaped material 1, 1'.

The ratio between the diameter of the bolt body 9 (in the region of the press fit thereof) and the diameter of the bolt head 7 may also be selected differently, in many cases it is sufficient if the maximum diameter of the part of the bolt body 9 pressed into the plate-shaped or strip-shaped material 1, 1' is at least 10%, preferably at least 20%, 30%, 40%, 50%, 60%, 70%, 80%, 90%, 100%, 110%, 120%, 130%, 140% or even 150% greater than the diameter of the bolt head 7. Conversely, it is generally sufficient if the maximum diameter of the bolt body 9 in the region of the press fit thereof is less than 200% greater than the diameter of the bolt head 7, thus in particular less than 180%, 160%, 150%, 140%, 130%, 120%, 110%, 100%, 90% or less than 80%. In the embodiment shown, the diameter of the bolt body 9 is approximately 75% to 90% greater than the diameter of the bolt head 7.

The invention claimed is:

1. Electrical connection device on a plate-shaped or strip-shaped material which is non-solderable or poorly solderable or is provided with a non-solderable or poorly solderable surface, comprising:

a press-in bolt pressed into the plate-shaped or strip-shaped material, the press-in bolt having an external circumferential region which is compressed with the plate-shaped or strip-shaped material to form a press fit, the press-in bolt consisting of an easily solderable material or covered at least in portions with an easily solderable material to form a soldering area, the press-in bolt comprising a bolt head which has a tapered cross-section by comparison with the bolt body located therebelow, in such a way that the bolt head transitions, via a flank which descends conically or in a shoulder shape, into the bolt body having an outer circumference of a larger diameter than the bolt head, the outer circumference of the bolt body being provided with a circumferential knurling that produces a non-positive connection between the press-in bolt and the adjacent non-solderable material or poorly solderable material or surface, the plate-shaped or strip-shaped material or surface provided with a bordered material rim in the region of the penetration by the press-in bolt, the material rim projecting transversely from the plate-shaped or strip-shaped material or surface, the bolt body being structured to make a hole through the nonsolderable or poorly solderable material or surface to cause said material or surface to gain a broken-up circumferential material rim in the region of penetration by the press-in bolt, and inside the material rim, a circumferential region of the bolt body of the press-in bolt is compressed to form a press fit, the head of the press-in bolt projecting beyond the material rim and being available as a soldering point, wherein the press-in bolt tapered cross-section is structured to provide high pressing forces in conjunction with a cylindrical internal wall in a recess of a corresponding die to form a circumferential material rim in the plate-shaped or strip-shaped material which is increasingly widened further during a continuing press-in movement of the press-in bolt, and wherein the conically-shaped or shoulder-shaped flank of the press-in bolt is configured to deform the plate-shaped or strip-shaped material during penetration of the press-in bolt into the plate-shaped or strip-shaped material in the manner of a punch to thereby form said material rim, the deformation of the non-solderable material or poorly solderable material being provided by the press-in bolt itself.

2. Connection device according to claim 1, wherein the press-in bolt projects beyond the height of the material rim of the plate-shaped or strip-shaped material in the axial direction.

3. Connection device according to claim 1, wherein the press-in bolt comprises a solderable bolt head or a solderable area on one side, on which the material rim is formed, of the plate-shaped or strip-shaped material, and comprises a base face having a solderable connection area on the other side of the plate-shaped or strip-shaped material.

4. Connection device according to claim 3, wherein the solderable bolt head projects beyond the plane of the plate-shaped or strip-shaped material, projecting axially beyond the material rim.

5. Connection device according to claim 3, wherein the underside or base of the press-in bolt is positioned in the same plane as the underside of the plate-shaped or strip-shaped material.

6. Connection device according to claim 3, wherein the underside or base of the press-in bolt is positioned above or below the plane formed by the underside of the plate-shaped or strip-shaped material.

7. Connection device according to claim 1, wherein the press-in bolt is formed, at least in sections, conically or slightly conically convergent towards the projecting material rim, in such a way that the press-in bolt transitions from the region having a smaller diameter towards its press fit in a region having a comparatively larger diameter.

8. Connection device according to claim 1, wherein the knurling formed on the outer circumference of the bolt body of the press-in bolt comprises ribs positioned mutually offset in the circumferential direction.

9. Connection device according to claim 8, wherein the ribs of the knurling are formed parallel to the axial direction of the press-in bolt or extend in an angular orientation or are formed in a cross-knurling.

10. Connection device according to claim 1, wherein the press-in bolt is also formed at least slightly conical in the region of the press fit thereof, comprising ribs which are formed at least slightly wedge-shaped and comprising flanks which lead in a wedge shape in a pressing direction and which are formed on the ribs.

11. Connection device according to claim 1, wherein the bolt body is formed, in the region of the press fit thereof, without knurling, with a restructured surface.

12. Connection device according to claim 1, wherein the press-in bolt is provided as a whole with a highly electrically conductive surface, being tin-coated or silver-coated.

13. Connection device according to claim 1, wherein the press-in bolt is selected from the group consisting of brass, copper and bronze.

14. Connection device according to claim 1, wherein at least one or two circumferential groove-shaped depressions are formed on the outer circumference of the press-in bolt, in the region of the press fit thereof.

15. Connection device according to claim 1, wherein the material thickness of the plate-shaped or strip-shaped material is greater than or equal to 0.5 mm.

16. Connection device according to claim 1, wherein the diameter of the bolt body in the region of the press fit thereof is at least 10% greater than the diameter of the bolt head, or the maximum diameter of the bolt body in the region of the press fit thereof is less than 200% greater than the diameter of the bolt head.

17. The connection device of claim 1 wherein the material rim is connected to the plate-shaped or strip-shaped material in a material fit, and forms during a production process by deforming a material portion of the plate-shaped or strip-shaped material, the material rim being thus biased on the outer circumference of the press-in bolt at a fixed bias, bringing about the press fit.

18. The connection device of claim 1 wherein the bordered material rim forms during press fitting to thereby exert a bias against the press-in bolt outer circumference.

* * * * *